US009017048B2

(12) United States Patent
Byun et al.

(10) Patent No.: US 9,017,048 B2
(45) Date of Patent: Apr. 28, 2015

(54) VARIABLE CAPACITY TYPE ROTARY COMPRESSOR, COOLING APPARATUS HAVING THE SAME, AND METHOD FOR DRIVING THE SAME

(75) Inventors: Sang-Myung Byun, Changwon (KR); Sang-Mo Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 453 days.

(21) Appl. No.: 13/059,374

(22) PCT Filed: Aug. 19, 2009

(86) PCT No.: PCT/KR2009/004618

§ 371 (c)(1),
(2), (4) Date: Feb. 16, 2011

(87) PCT Pub. No.: WO2010/021491

PCT Pub. Date: Feb. 25, 2010

(65) Prior Publication Data

US 2011/0138848 A1 Jun. 16, 2011

(30) Foreign Application Priority Data

Aug. 22, 2008 (KR) ..... 10-2008-0082506

(51) Int. Cl.
*F01C 20/18* (2006.01)
*F04C 18/356* (2006.01)
(Continued)

(52) U.S. Cl.
CPC ..... *F04C 18/3564* (2013.01); *F01C 1/3564* (2013.01); *F01C 21/0863* (2013.01);
(Continued)

(58) Field of Classification Search
CPC ..... F25B 2600/027; F25B 2600/0271; F25B 2600/0272; F25B 2700/193; F25B 2700/1931; F25B 2700/1933
USPC ..... 62/498, 402, 196.1, 176.3; 418/23
See application file for complete search history.

(56) References Cited

U.S. PATENT DOCUMENTS

2001/0029747 A1* 10/2001 Gaul ..... 62/498
2006/0277931 A1* 12/2006 Nakamura et al. ..... 62/196.1
(Continued)

FOREIGN PATENT DOCUMENTS

CN 101344089 1/2009
EP 1 813 814 8/2007
(Continued)

OTHER PUBLICATIONS

Chinese Office Action dated Nov. 30, 2012.
(Continued)

*Primary Examiner* — Mohammad M Ali
*Assistant Examiner* — Raheena Rehman
(74) *Attorney, Agent, or Firm* — KED & Associates, LLP

(57) ABSTRACT

A variable capacity type rotary compressor and a cooling apparatus having the same, and an operation method thereof are provided. In the variable capacity type rotary compressor and the cooling apparatus having the same, a discharge pressure is supplied to a rear side of a second vane disposed in the compressor after the discharge pressure is higher than a reference pressure, so that the compressor is switched from a saving mode into a power mode. The second vane is press-contacted with a second rolling piston with fast and accurately moving without vibration, resulting in preventing beforehand noise occurrence or efficiency degradation due to the vibration of the second vane when the compressor or the cooling apparatus having the compressor is operated in the power mode.

9 Claims, 8 Drawing Sheets

(51) Int. Cl.

| | |
|---|---|
| ***F01C 1/356*** | (2006.01) |
| ***F01C 21/08*** | (2006.01) |
| ***F04C 28/06*** | (2006.01) |
| ***F04C 28/26*** | (2006.01) |
| ***F04C 28/28*** | (2006.01) |
| *F04C 23/00* | (2006.01) |

(52) U.S. Cl.
CPC ..... *F04C28/065* (2013.01); *F04C 28/26* (2013.01); *F04C 28/28* (2013.01); *F04C 23/008* (2013.01); *F04C 2270/12* (2013.01); *F04C 2270/13* (2013.01)

(56) References Cited

U.S. PATENT DOCUMENTS

| | | | | |
|---|---|---|---|---|
| 2008/0092586 | A1* | 4/2008 | Kitaichi et al. | 62/498 |
| 2008/0184723 | A1* | 8/2008 | Sato et al. | 62/228.1 |
| 2008/0193310 | A1* | 8/2008 | Byun et al. | 418/23 |
| 2008/0209925 | A1* | 9/2008 | Pham | 62/126 |
| 2008/0256961 | A1* | 10/2008 | Lifson et al. | 62/115 |
| 2008/0314057 | A1* | 12/2008 | Lifson et al. | 62/228.4 |
| 2009/0013701 | A1* | 1/2009 | Lifson et al. | 62/77 |
| 2010/0251757 | A1* | 10/2010 | Hasegawa et al. | 62/468 |
| 2010/0326124 | A1* | 12/2010 | Takahashi et al. | 62/468 |

FOREIGN PATENT DOCUMENTS

| | | | | |
|---|---|---|---|---|
| JP | 63-219891 | | | 9/1988 |
| JP | 6-321989 | | | 11/1994 |
| JP | 2007-146747 | | | 6/2007 |
| JP | 2007146747 | A | * | 6/2007 |
| KR | 10-0621027 | B1 | | 9/2006 |
| KR | 10-0816655 | B1 | | 3/2008 |
| KR | 10-2008-0062939 | A | | 7/2008 |
| WO | WO 2006/090977 | | | 8/2006 |
| WO | WO 2006090977 | A1 | * | 8/2006 |
| WO | WO 2007106116 | A1 | * | 9/2007 |
| WO | WO 2008/050654 | | | 5/2008 |
| WO | WO 2008050654 | A1 | * | 5/2008 |

OTHER PUBLICATIONS

International Search Report issued in PCT Application No. PCT/KR2009/004618.

Notice of Allowance issued by the Korean Intellectual Property Office in related Application No. 10-2008-0082506 dated Jun. 2, 2014.

Chinese Office Action dated Jul. 10, 2014. (translation).

* cited by examiner

VARIABLE CAPACITY TYPE ROTARY COMPRESSOR, COOLING APPARATUS HAVING THE SAME, AND METHOD FOR DRIVING THE SAME

TECHNICAL FIELD

The present invention relates to a variable capacity type rotary compressor capable of being selectively operated in a power mode and a saving mode, a cooling apparatus having the same, and a method for driving the same.

BACKGROUND ART

In general, a cooling apparatus is an apparatus employing a refrigerant compression type refrigerating cycle provided with a compressor, a condenser, an expansion apparatus and an evaporator and using cold air generated by a phase change of the refrigerant. The cooling apparatuses employing the refrigerant compression type refrigerating cycle includes representatively well-known air conditioners, refrigerators and the like.

A constant-speed type compressor driven at constant speed and an inverter type compressor capable of controlling rotation speed have been introduced as refrigerant compressors (hereinafter, referred to as compressor) employed in the refrigerant compression type refrigerating cycle.

A compressor, in which a driving motor (typically, an electric motor) and a compression part operated by the driving motor are all installed in an inner space of a hermetic casing, is referred to as a hermetic type compressor, and a compressor of which the driving motor is separately installed outside the casing is referred to as an open type compressor. Home or commercial cooling apparatuses usually employ the hermetic type compressor. Such hermetic type compressors may be categorized into a reciprocating type, a scroll type, a rotary type and the like according to a refrigerant compression mechanism.

The rotary compressor compresses a refrigerant by use of a rolling piston eccentrically rotating in a compression space of a cylinder and a vane contacted with a rolling piston for partitioning the compression space of the cylinder into a suction chamber and a discharge chamber. In recent time, a variable capacity type rotary compressor capable of varying a cooling capacity of the compressor according to the change in a load has been introduced. Well-known technologies for varying the cooling capacity of the compressor include applying an inverter motor, and varying a volume of a compression chamber by bypassing part of a compressed refrigerant out of a cylinder. However, for employing the inverter motor, a driver for driving the inerter motor is about 10 times as expensive as a driver of a constant-speed motor, thereby rising a fabrication cost of the compressor. On the other hand, for bypassing the refrigerant, a piping system becomes complicated and accordingly a flow resistance of the refrigerant is increased, thereby lowering efficiency of the compressor.

Considering such drawbacks, a so-called independent suction type variable capacity rotary compressor (hereinafter, referred to as independent suction type rotary compressor), in which a plurality of cylinders are provided and at least one of them is allowed for idling, is introduced. The independent suction type rotary compressor is configured such that each of the plural cylinders has a rolling piston and a vane for forming a compression chamber together with the rolling piston, and at least one vane is supported by a variable pressure applied thereto. A mode switching device for varying pressure is connected to a rear side of the vane.

DISCLOSURE OF INVENTION

Technical Problem

However, in the related art compressor having the mode switching device or the cooling apparatus having the compressor, since the mode switching device is forcibly operated according to the change in environmental conditions around the device, the capacity of the compressor is not smoothly varied. For instance, under the state where the rear side pressure of the vane is not risen as sufficient as allowing a mode switching, even if the mode switching device is operated, the vane is not closely adhered to the rolling piston, which may cause a type of vane vibration. Consequently, compressor noise may be generated and also energy efficiencies of the compressor and a cooling apparatus employing the compressor may be lowered due to unnecessary power consumption.

Therefore, to solve those drawbacks of the related art variable capacity type rotary compressor and the cooling apparatus having the same, the present invention provides a variable capacity type rotary compressor, in which a plurality of cylinders, rolling pistons and vanes are provided and at least one vane is supported by a variable pressure, whereby a stable operation of the vanes can be ensured by designating a mode switching timing and efficiency of the compressor can be improved by reducing power consumption amount, and a cooling apparatus having the same.

Solution to Problem

To achieve these and other advantages and in accordance with the purpose of the present invention, as embodied and broadly described herein, there is provided a variable capacity type rotary compressor including, a casing having a suction pipe and a discharge pipe, at least one cylinder installed in an inner space of the casing, at least one rolling piston configured to compress a refrigerant by being orbited in a compression space of the cylinder, at least one vane configured to partition the compression space of the cylinder into a suction chamber and a discharge chamber in cooperation with the rolling piston, a mode switching unit configured to apply a variable pressure to at least one of the vanes so as to be supported by the variable pressure, and a control unit configured to control the mode switching unit to switch an operation mode when a differential pressure between a discharge pressure discharged from the cylinder and a suction pressure sucked into the cylinder reaches a preset reference pressure.

In another aspect of the present invention, there is provided a method for operating a variable capacity type rotary compressor, having an operation mode thereof switched into a power mode and a saving mode, wherein a differential pressure between a discharge pressure and a suction pressure is detected prior to switching the operation mode into the power mode, and the operation mode is switched into the power mode if the detected value is not smaller than a reference value.

In another aspect of the present invention, there is provided with a cooling apparatus having a refrigerant compression type refrigerating cycle provided with a compressor, a condenser, an expansion apparatus and an evaporator, wherein the compressor is implemented as the variable capacity type rotary compressor.

Advantageous Effects of Invention

In the variable capacity type rotary compressor and the cooling apparatus having the same, a discharge pressure to be supplied to a rear side of a second vane disposed in the compressor is supplied after being higher than a reference pressure, so that the compressor can be switched from a saving mode into a power mode, whereby the second vane can be press-contacted with a second rolling piston with fast and accurately moving without vibration, resulting in preventing beforehand noise occurrence or efficiency degradation due to the vibration of the second vane when the compressor or the cooling apparatus having the compressor is operated in the power mode.

The foregoing and other objects, features, aspects and advantages of the present invention will become more apparent from the following detailed description of the present invention when taken in conjunction with the accompanying drawings.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Description will now be given in detail of a variable capacity type rotary compressor in accordance with one embodiment of the present invention, with reference to the accompanying drawings.

Figure 1:
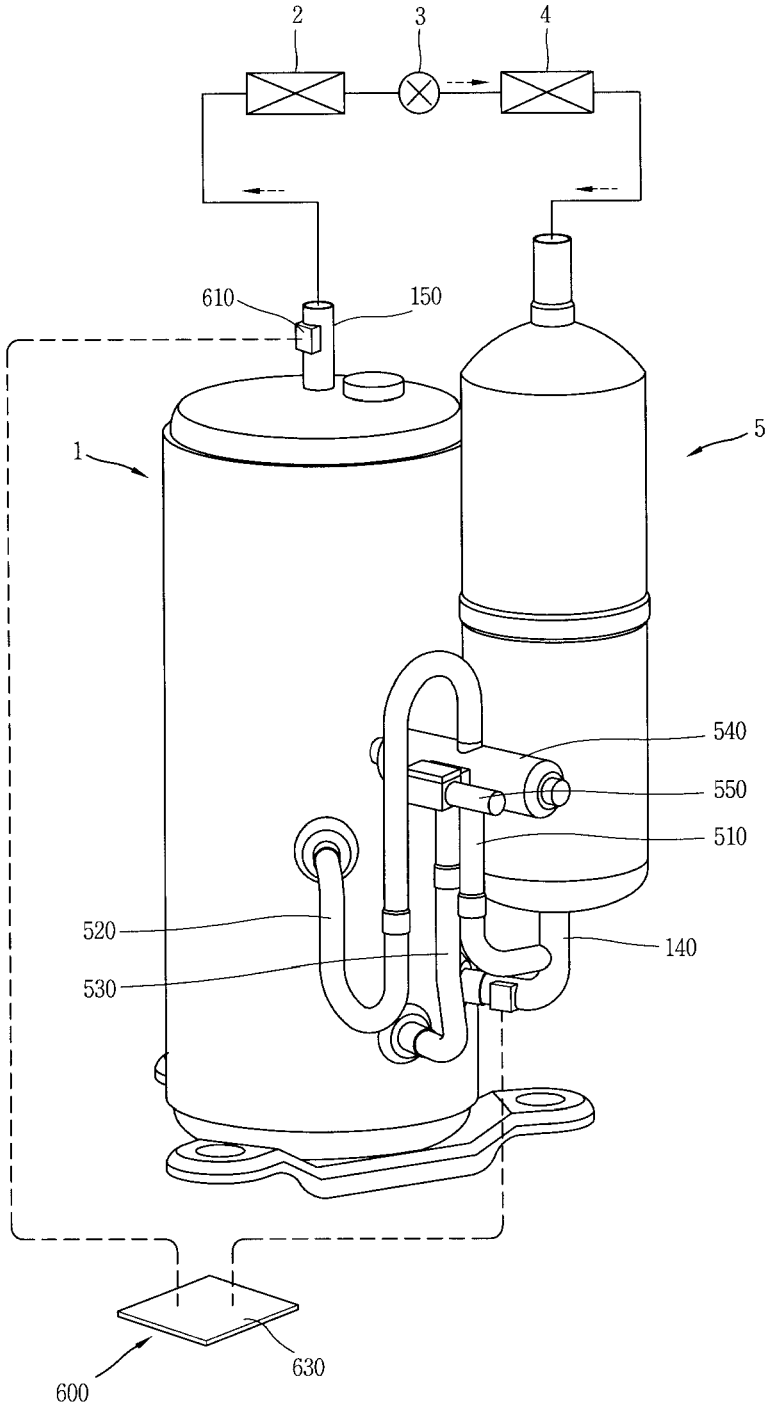
FIG. 1 is a schematic view of a refrigerating cycle including a variable capacity type rotary compressor in accordance with the present invention.

As shown in FIG. 1, a variable capacity type rotary compressor 1 according to the present invention may be configured such that a suction side thereof is connected to an outlet side of an evaporator 4 and simultaneously a discharge side thereof is connected to an inlet side of a condenser 2 so as to form a part of a closed loop refrigerating cycle including the condenser 2, an expansion apparatus 3 and the evaporator 4. An accumulator 5 for separating a refrigerant carried from the evaporator 4 to the compressor 1 into a gaseous refrigerant and a liquid refrigerant may be connected between the discharge side of the evaporator 4 and the inlet side of the compressor 1.

The compressor 1, as shown in FIG. 1, may include a motor part 200 installed at an upper side of an inner space of a hermetic casing 100 for generating a driving force, and first and second compression parts 300 and 400 installed at a lower side of the inner space of the casing 100 for compressing a refrigerant by the driving force generated from the motor part 200. A mode switching unit 500 for switching an operation mode of the compressor 1 such that the second compression part 400 is idled if necessary may be installed outside the casing 100.

The casing 100 may have the inner space maintained in a discharge pressure state by a refrigerant discharged from the first and second compression parts 300 and 400 or from the first compression part 300. One suction pipe 140 through which a refrigerant is sucked between the first and second compression parts 300 and 400 may be connected to a circumferential surface of a lower portion of the casing 100. A discharge pipe 150 through which the refrigerant discharged after being compressed in the first and second compression parts 300 and 400 flows into a cooling system may be connected to an upper end of the casing 100. The suction pipe 140 may be inserted into an intermediate connection pipe (not shown), which is inserted into a communication passage 131 of the intermediate bearing 130 to be explained later, so as to be welded for coupling.

The motor part 200 may include a stator 210 fixed onto an inner circumferential surface of the casing 100, a rotor 220 rotatably disposed in the stator 210, and a rotation shaft 230 shrink-fitted with the rotor 220 so as to be rotated together with the rotor 220. The motor part 200 may be implemented as a constant-speed motor or an inverter motor. However, an operation mode of the compressor can be switched by idling any one of the first and second compression parts 300 and 400, if necessary, even with employing the constant-speed motor, considering a fabricating cost.

The rotation shaft 230 may include a shaft portion 231 coupled to the rotor 220, and a first eccentric portion 232 and a second eccentric portion 233 both disposed at a lower end section of the shaft portion 231 to be eccentric to both right and left sides. The first eccentric portion 232 and the second eccentric portion 233 may be symmetric to each other with a phase difference of about 180, and rotatably coupled to a first rolling piston 320 and a second rolling piston 420, respectively.

The first compression part 300 may include a first cylinder 310 formed in an annular shape and installed inside the casing 100, a first rolling piston 320 rotatably coupled to the first eccentric portion 232 of the rotation shaft 230 and configured to compress a refrigerant by being orbited in a first compression space V1 of the first cylinder 310, a first vane 330 movably coupled to the first cylinder 310 in a radial direction, with a sealing surface of its one side being contacted with an outer circumferential surface of the first rolling piston 320, and configured to partition the first compression space V1 of the first cylinder 310 into a first suction chamber and a first discharge chamber, and a vane spring 340 configured as a compression spring for elastically supporting a rear side of the first vane 330. Unexplained reference numeral 350 denotes a first discharge valve, and 360 denotes a first muffler.

The second compression part 400 may include a second cylinder 410 formed in an annular shape and installed below the first cylinder 310 inside the casing 100, a second rolling piston 420 rotatably coupled to the second eccentric portion 233 of the rotation shaft 230 and configured to compress a refrigerant by being orbited in a second compression space V2 of the second cylinder 410, and a second vane 430 movable coupled to the second cylinder 410 in a radial direction, and contacted with an outer circumferential surface of the second rolling piston 420 so as to partition the second compression space V2 of the second cylinder 410 into a second suction chamber and a second discharge chamber or spaced from the outer circumferential surface of the second rolling piston 429 so as to communicate the second suction chamber with the second discharge chamber. Unexplained reference numeral 440 denotes a second discharge valve, and 450 denotes a second muffler.

Here, an upper bearing plate (hereinafter, referred to as upper bearing) 110 covers the upper side of the first cylinder 310, and a lower bearing plate (hereinafter, referred to as lower bearing) 120 covers the lower side of the second cylinder 410. Also, an intermediate bearing plate (hereinafter, referred to as intermediate bearing) 130 is interposed between the lower side of the first cylinder 310 and the upper side of the second cylinder 410 so as to support the rotation shaft 230 in a shaft direction with forming the first compression space V1 and the second compression space V2.

Figure 3:
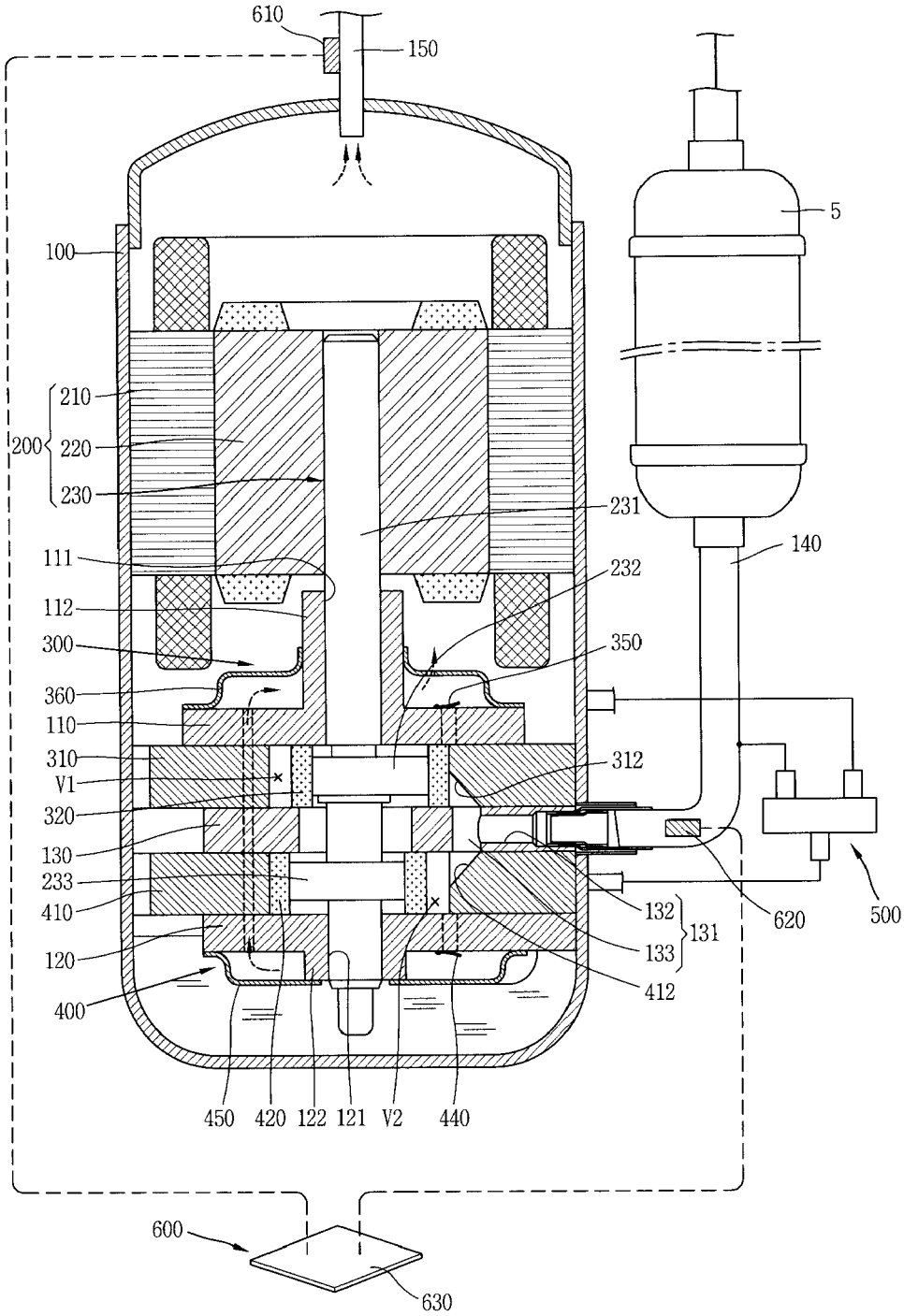
FIG. 3 is a longitudinal cross-sectional view showing an inside of the rotary compressor in accordance with FIG. 1, by being longitudinally cut based upon a suction hole.
Figure 4:
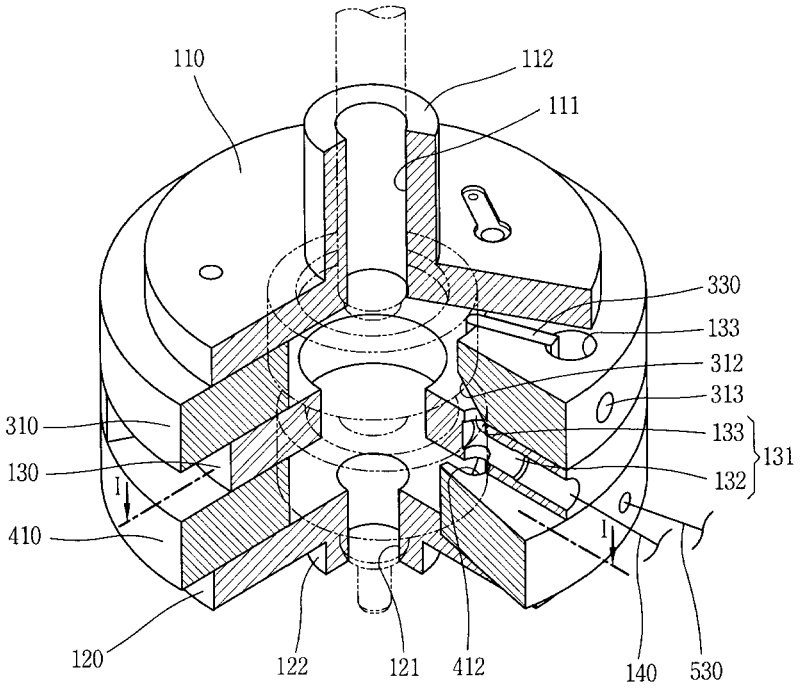
FIG. 4 is a perspective view showing a broken compression part of the rotary compressor in accordance with FIG. 1.

As shown in FIGS. 3 and 4, the upper bearing 110 and the lower bearing 120 are formed in a disc shape, and shaft supporting portions 112 and 122 having shaft holes 111 and 121 for supporting the shaft portion 231 of the rotation shaft 230 in a radial direction may protrude from respective centers thereof. The intermediate bearing 130 is formed in an annular shape with an inner diameter large enough to allow the eccentric portions of the rotation shaft 230 to be penetrated therethrough. A communication passage 131 through which a first suction hole 312 and a second suction hole 412 to be explained later can be communicated with the suction pipe 140 may be formed at one side of the intermediate bearing 130.

The communication passage 131 of the intermediate bearing 130 may be provided with a horizontal path 132 formed in a radial direction to be communicated with the suction pipe 140, and a longitudinal path 133 formed at an end of the horizontal path 132 and formed through in a shaft direction for communicating the first suction hole 312 and the second suction hole 412 with the horizontal path 132. The horizontal path 132 may be recessed by a prescribed depth from an outer circumferential surface of the intermediate bearing 130 toward an inner circumferential surface thereof, namely, by a depth not completely enough to be communicated with the inner circumferential surface of the intermediate bearing 130.

The first cylinder 310 may be provided with a first vane slot 311 formed at one side of its inner circumferential surface forming the first compression space V1 for allowing the first vane 330 to be linearly reciprocated, a first suction hole 312 formed at one side of the first vane slot 311 for inducing a refrigerant into the first compression space V1, and a first discharge guiding groove (not shown) formed at another side of the first vane slot 311 by chamfering an edge at an opposite side of the first suction hole 312 with an inclination angle, so as to guide a refrigerant to be discharged into an inner space of the first muffler 360.

The second cylinder 410 may be provided with a second vane slot 411 formed at one side of its inner circumferential surface forming the second compression space V2 for allowing the second vane 430 to be linearly reciprocated, a second suction hole 412 formed at one side of the second vane slot 411 for inducing a refrigerant into the second compression space V2, and a second discharge guiding groove (not shown) formed at another side of the second vane slot 411 by chamfering an edge at an opposite side of the second suction hole 412 with an inclination angle so as to guide a refrigerant to be discharged into an inner space of the second muffler 450.

The first suction hole 312 may be formed with an inclination angle by chamfering an edge of a lower surface of the first cylinder 310, contacted with an upper end of the longitudinal path 133 of the intermediate bearing 130, toward the inner circumferential surface of the first cylinder 310.

The second suction hole 412 may be formed with an inclination angle by chamfering an edge of an upper surface of the second cylinder 410, contacted with a lower end of the longitudinal path 133 of the intermediate bearing 130, toward the inner circumferential surface of the second cylinder 410.

Here, the first suction hole 312 and the second suction hole 412 may be formed such that, from a plane projection image, central lines thereof in a radial direction intersect with shaft centers of the cylinders 310 and 410 having the suction holes 312 and 412, respectively. Also, the first suction hole 312 and the second suction hole 412 may be symmetric to each other on a straight line in the shaft direction based upon the communication passage 131.

Further, referring to FIG. 3, the first vane slot 311 may be formed by cutting (recessing) the first cylinder 310 into a preset depth in a radial direction such that the first vane 330 can be linearly reciprocated. A through hole 313, as shown in FIG. 4, may be formed through a rear side of the first vane slot 311, namely, a portion on an outer circumferential surface of the first cylinder 310, so as to be communicated with the inner space of the casing 100. A vane spring 340 may be installed in the through hole 313 of the first cylinder 310.

The second vane slot 411 may be formed by cutting (recessing) the second cylinder 410 into a preset depth in a radial direction such that the second vane 430 can be linearly reciprocated. A vane chamber 413 may be formed through a rear side of the second vane slot 411, namely, a portion on an outer circumferential surface of the second cylinder 410, so as to be communicated with a common connection pipe 530 to be explained later. The vane chamber 413 may be hermetically coupled by the intermediate bearing 130 and the lower bearing 120 contacting with its upper and lower surfaces so as to be isolated within the inner space of the casing 100.

An intermediate connection pipe (not shown) may be press-fitted to the vane chamber 413 such that a front side thereof can be communicated with the front side of the vane chamber 413 and a rear side thereof can be welded with the common connection pipe 530. The vane chamber 413 may have a preset inner volume such that the rear surface of the second vane 430 can serve as a pressed surface by a refrigerant supplied via the common connection pipe 530 even if the second vane 430 is completely retracted to be accommodated within the second vane slot 411.

Figure 5:
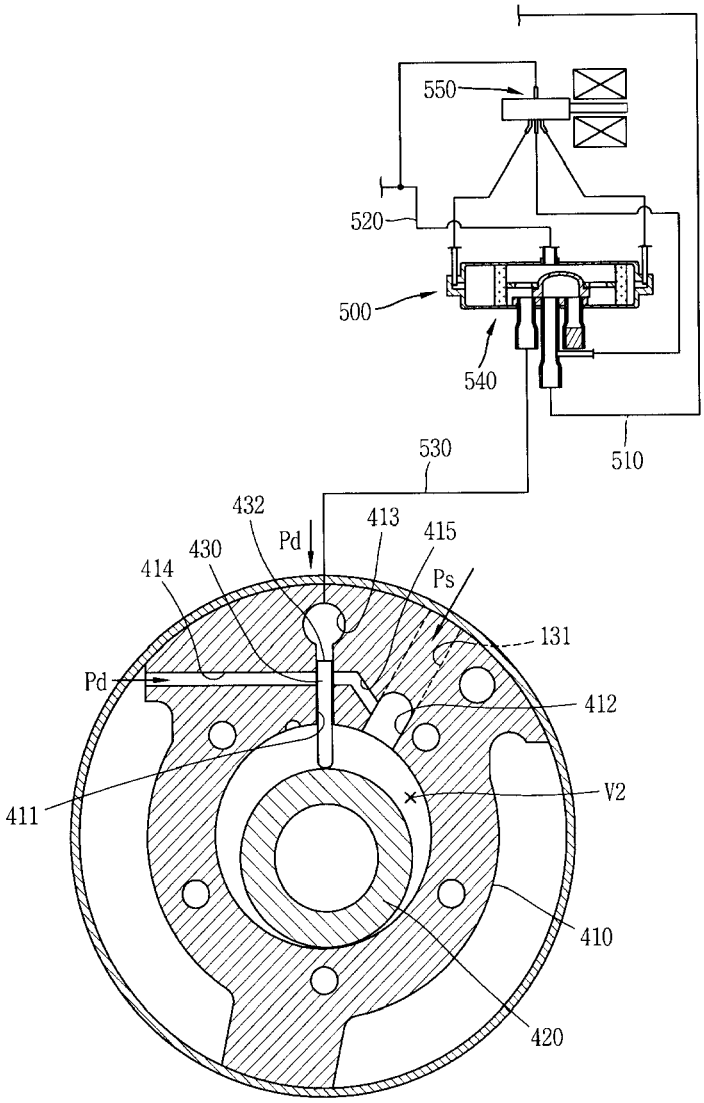
FIG. 5 is a view showing restricting passages for restricting a second vane in the rotary compressor in accordance with FIG. 1, which is a view taken along the line I-I of FIG. 4.

Here, the pressed surface of the second vane 430 is supported by a refrigerant of a suction pressure or a refrigerant of a discharge pressure filled in the vane chamber 413 such that a sealing surface thereof comes in contact with or is spaced from the second rolling piston 420 according to an operation mode of the compressor. Accordingly, in order to prevent beforehand compressor noise or efficiency degradation due to the vibration of the second vane 430, the second vane 430 should be restricted within the second vane slot 411 in a particular operation mode of the compressor, i.e., in a saving mode. To this end, a restriction method for the second vane using internal pressure of the casing 100, as shown in FIG. 5, may be proposed.

For instance, the second cylinder 410 may be provided with a high pressure side vane restricting passage (hereinafter, referred to as first restricting passage) 414 orthogonal to a motion direction of the second vane 430 or formed in a direction at least having a stagger angle with respect to the second vane 430. The first restricting passage 414 allows the inside of the casing 100 to be communicated with the second vane slot 411 such that a refrigerant of discharge pressure filled in the inner space of the casing 100 pushes the second vane 430 towards an opposite vane slot surface, thereby restricting the second vane 430. A lower pressure side vane restricting passage (hereinafter, referred to as second restricting passage) for allowing the second vane slot 411 to be communicated with the second suction hole 412 may be formed at an opposite side of the first restricting passage 414. The second restricting passage 415 generates a pressure difference from the first restricting passage 414 such that a refrigerant of discharge pressure introduced via the first restricting passage 414 flows through the second restricting passage 415, thereby quickly restricting the second vane 430.

The first restricting passage 414 may be positioned near the discharge guiding groove (no reference numeral given) of the second cylinder 410 based upon the second vane 430 and formed through the outer circumferential surface of the second cylinder 410 to the center of the second vane slot 411. The first restricting passage 414 may be formed to be two-stepped by using a two-stepped drill such that a portion of the first restricting passage 414 near the second vane slot 411 can be narrower. Also, an outlet of the first restricting passage 414 may be positioned approximately in the middle of the second vane slot 411 in a lengthwise direction of the second vane slot 411 such that a linear motion of the second vane 430 can be stably achieved. The first restricting passage 414 may be formed at a position where it can be communicated with the vane chamber 413 via a gap between the second vane 430 and the second vane slot 411 in a power mode of the compressor, such that the refrigerant of discharge pressure can be introduced into the vane chamber 413 via the first restricting passage 414, thereby increasing the rear side pressure of the second vane 430. However, in the saving mode of the compressor, when the second vane 430 is restricted, the first restricting passage 414 is communicated with the vane chamber 413 so as to increase the pressure of the vane chamber 413, and accordingly the second vane 430 can be pressed by the pressure, which may cause vibration of the second vane 430. Accordingly, the first restricting passage 414 may preferably be formed to be positioned within a reciprocating range of the second vane 430.

The first restricting passage 414 may have a sectional area equal to or smaller than a sectional area of a pressed surface 432 of the second vane 430 by the pressure from the vane chamber 413, thereby preventing the excessive restriction of the second vane 430. For example, when dividing the sectional area of the first restricting passage 414 by a vane area of the second vane 430, namely, a vane area of a side surface thereof to which the restricting pressure is applied, the sectional area of the first restricting passage 414 may preferably be in a specific range, which thusly allows a minimization of noise occurred by a mode switching.

Although not shown in the drawing, the first restricting passage 414 may be recessed into both upper and lower surfaces of the second cylinder 410 by a preset depth. Alternatively, the first restricting passage 414 may be recessed into or penetrated through the intermediate bearing 130 or the lower bearing 120 coupled to the upper and lower surfaces of the second cylinder 410. Here, if the second restricting passage 415 is recessed into the upper surface of the lower bearing 120 or the lower surface of the intermediate bearing 130, the second restricting passage 415 may be formed simultaneously when sintering the second cylinder 140 or each bearing 120 and 130, thereby reducing the fabricating cost.

The second restricting passage 415 may preferably be disposed on the same line as the first restricting passage 414, if possible, so as to cause the pressure difference between discharge pressure and suction pressure at both side surfaces orthogonal to a motion direction of the second vane 430, thereby closely adhering the second vane 430 to the second vane slot 411 by the pressure difference. However, since the second suction hole 412 is inclined in the shaft direction, the second restricting passage 314 may be inclined or curved so as to be communicated with the second suction hole 412.

The second restricting passage 415 may preferably be formed at a position where it can be communicated with the vane chamber 413 via a gap between the second vane 430 and the second vane slot 411 in the saving mode of the compressor. However, when the second vane 430 moves forward in the power mode of the compressor, the second restricting passage 415 is communicated with the vane chamber 413 and accordingly, a refrigerant of discharge pressure Pd filled in the vane chamber 413 may be leaked into the second suction hole 412 so as not to sufficiently support the second vane 430. Hence, the second restricting passage 415 may preferably be formed to be positioned within the reciprocating range of the second vane 430.

Figure 2:
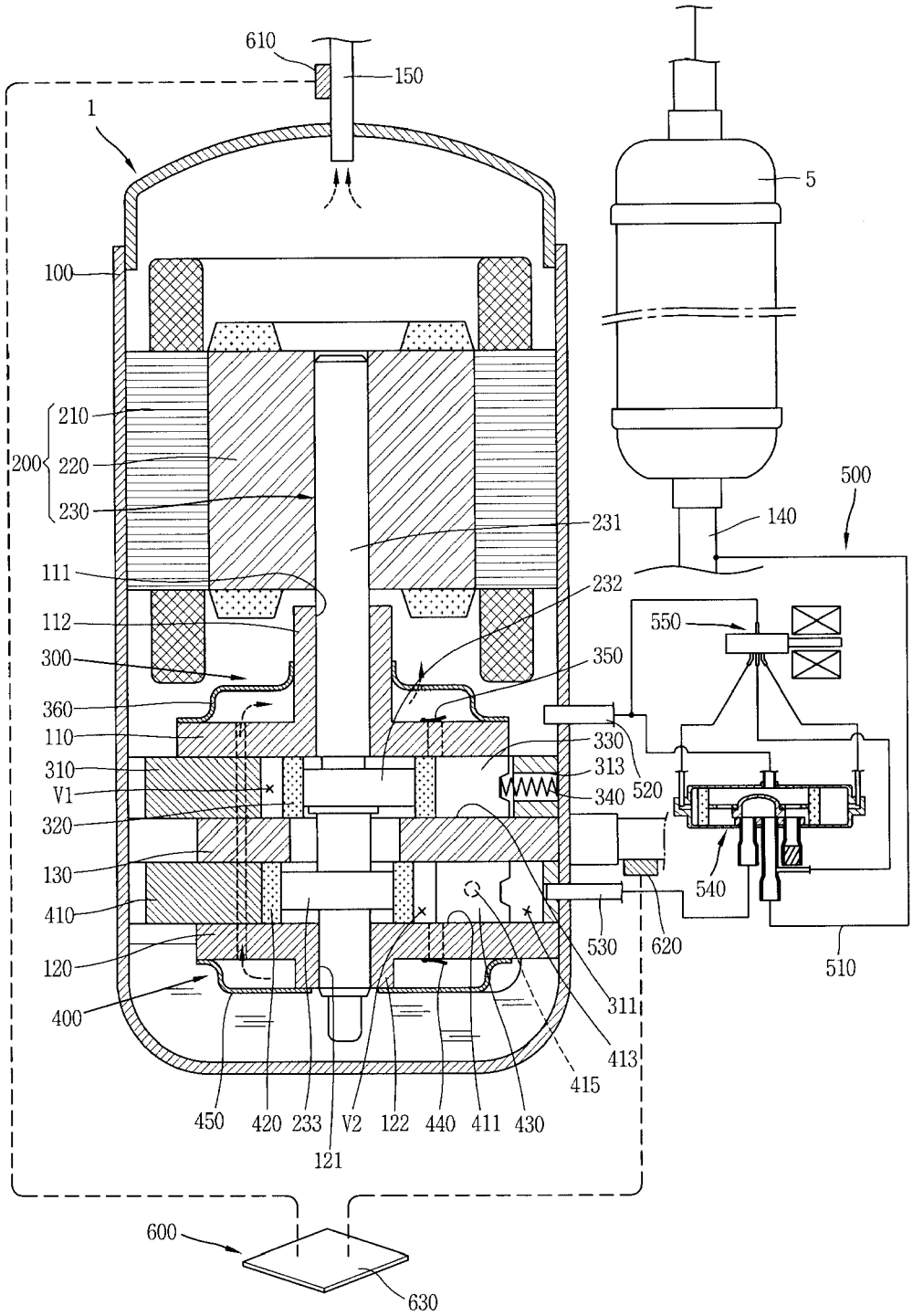
FIG. 2 is a longitudinal cross-sectional view showing an inside of the rotary compressor in accordance with FIG. 1 by being longitudinally cut based upon a vane.

The mode switching unit 500, as shown in FIGS. 1 to 3, may include a suction pressure side connection pipe 510 having one end diverged from the suction pipe 140, a discharge pressure side connection pipe 520 having one end connected to the inner space of the casing 100, a common connection pipe 530 having one end connected to the vane chamber 413 of the second cylinder 410 so as to be selectively communicated with the suction pressure side connection pipe 510 and the discharge pressure side connection pipe 520, a first mode switching valve 540 connected to the vane chamber 413 of the second cylinder 410 via the common connection pipe 530, and a second mode switching valve 550 connected to the first mode switching valve 540 for controlling the switching operation of the first switching valve 540.

The suction pressure side connection pipe 510 may have another end connected to a first inlet of the first mode switching valve 540, and the discharge pressure side connection pipe 520 may have another end connected to a second inlet of the first mode switching valve 540. Also, the common connection pipe 530 may have another end connected to an outlet of the first mode switching valve 540. Both ends of the suction pressure side connection pipe 510 may be welded with the suction pipe 140 and the first mode switching valve 540, respectively. Both ends of the discharge pressure side connection pipe 520 may be welded with the casing 100 (more particularly, an intermediate connection pipe sealing-coupled to the inner space of the casing 100) and the first mode switching valve 540, respectively. Both ends of the common connection pipe 530 may be welded with the intermediate bearing 130 (more particularly, an intermediate connection pipe sealing-coupled to the intermediate bearing 130) and the first mode switching valve 540, respectively.

The second mode switching valve 550 may electrically be connected to a control unit 600 for controlling an operation of a compressor or an operation of a cooling apparatus having the compressor, thereby being controlled to switch the operation mode of the compressor.

The control unit 600, as shown in FIGS. 1 to 3, may include a first sensor 610 for detecting pressures of refrigerants discharged from the cylinders 310 and 410, a second sensor 620 for detecting pressures of refrigerants sucked into the cylinders 310 and 410, and a control board 530 for determining whether to switch an operation mode by comparing each of the detected values by the first sensor 610 and the second sensor 620 with a reference pressure P1.

The first sensor 610 may be installed in the inner space of the casing 100 for detecting the pressure in the inner space of the casing 100 or installed at the middle of the discharge pipe 150 for detecting the internal pressure of the discharge pipe 150.

The second sensor 620 may be installed at the middle of the suction pipe for detecting the internal pressure of the suction pipe 140.

Figure 6:
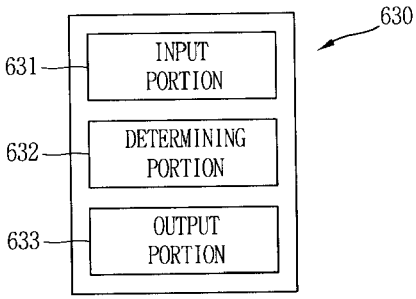
FIG. 6 is a schematic view showing a configuration of a control board of the rotary compressor in accordance with FIG. 1.

The control board 630 may electrically be connected to the first sensor 610 and the second sensor 620 so as to control the second mode switching valve 550 to perform the mode switching when a differential pressure ΔP between a discharge pressure Pd discharged from the compression spaces V1 and V2 of the cylinders 310 and 410 and a suction pressure Ps sucked into the compression spaces V1 and V2 of the cylinders 310 and 410 reaches a preset reference pressure P1. That is, as shown in FIG. 6, the control board 630 may be provided with an input portion 631 electrically connected to the first sensor 610 and the second sensor 620 for receiving pressures detected by the sensors 610 and 620, a determining portion 632 for calculating the differential pressure ΔP between the discharge pressure Pd and suction pressure Ps received by the input portion 631 and monitoring whether the calculated value reaches the preset reference pressure P1, thus to determine whether to switch the operation mode of the compressor, and an output portion 633 for switching the operation mode of the compressor according to the determined result of the determining portion 632.

Figure 7:
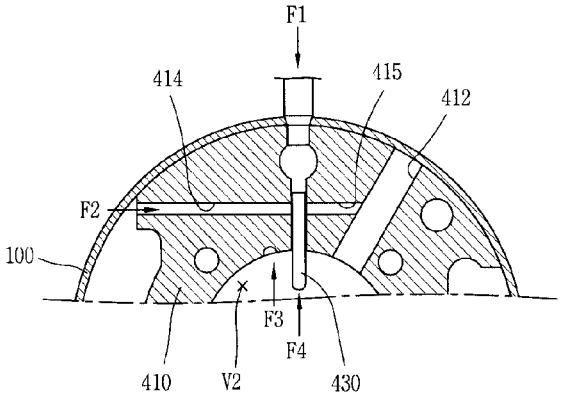
FIG. 7 is a horizontal cross-sectional view showing forces formed around the second vane of the rotary compressor in accordance with FIG. 1.

Here, the differential pressure ΔP, as shown in FIG. 7, may be indicated by the relation between a force F1 by the rear side pressure applied to a rear end of the second vane 430 and the sum (F2+F3+F4) of a force F2 by a lateral pressure applied to the side surface of the second vane 430, an inertial force F3 of the second vane 430 and a force F4 applied to a front surface of the second vane 430.

The reference pressure may be set to 2 $kgf/cm^2$; however, it may depend on the capacity of the compressor.

A basic compression process of the variable capacity type rotary compressor according to the present invention will be described hereinafter.

That is, when power is applied to the stator 210 of the motor part 200 and the rotor 220 is rotated accordingly, the rotation shaft 230 is rotated together with the rotor 220, thereby transferring the rotational force of the motor part 200 both to the first compression part 300 and the second compression part 400. In the first compression part 300 and the second compression part 400, the first rolling piston 320 and the second rolling piston 420 are eccentrically rotated in the first compression space V1 and the second compression space V2, respectively. Also, the first vane 330 and the second vane 430 then compress a refrigerant with forming the compression spaces V1 and V2 with a phase difference of 180 in cooperation with the first and second rolling pistons 320 and 420.

For instance, upon initiating a suction process in the first compression space V1, a refrigerant is introduced into the communication passage 131 of the intermediate bearing 130 via the accumulator 5 and the suction pipe 140. Such refrigerant is then sucked into the first compression space V1 via the first suction hole 312 of the first cylinder 310 to be then compressed therein. While executing the compression process in the first compression space V1, a suction process is initiated in the second compression space V2 of the second cylinder 410 with a phase different of 180 with the first compression space V1. Here, the second suction hole 412 of the second cylinder 410 is communicated with the communication passage 131 such that the refrigerant is sucked into the second compression space V2 via the second suction hole 412 of the second cylinder 410 to be then compressed therein.

A process of varying the capacity of the variable capacity type rotary compressor according to the present invention will be described hereinafter.

Figure 8:
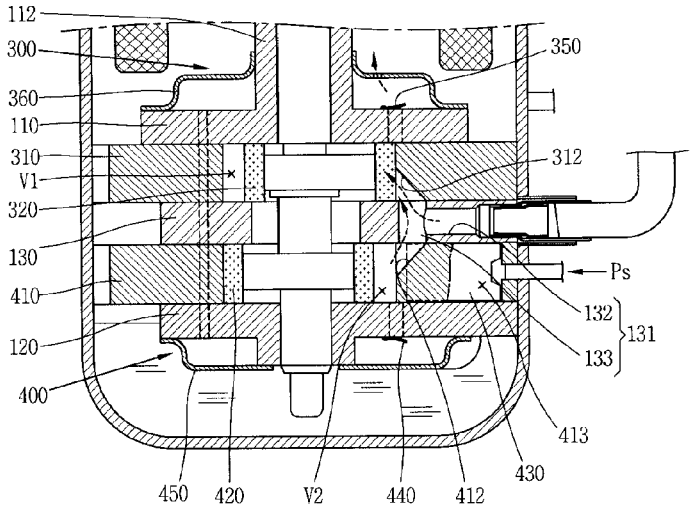
FIGS. 8 and 9 are longitudinal and horizontal cross-sectional views showing a saving operation mode of the rotary compressor in accordance with FIG. 1.
Figure 9:
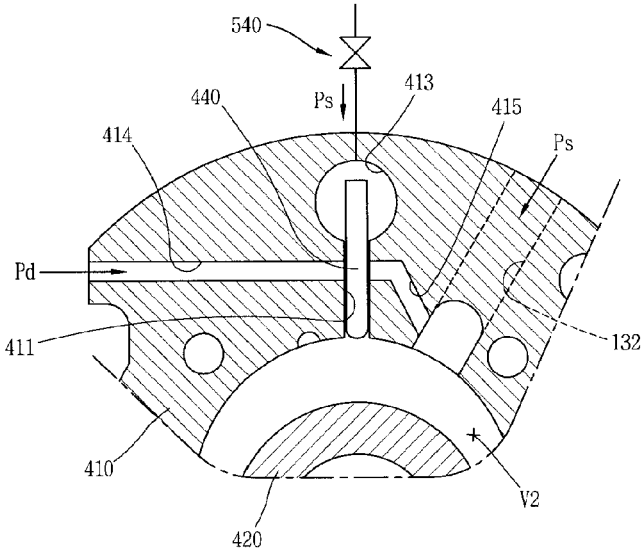

That is, in a saving mode, such as upon initiating the compressor, as shown in FIGS. 8 and 9, power is not supplied to the first mode switching valve 540. Accordingly, the suction pressure side connection pipe 510 is communicated with the common connection pipe 530 and a refrigerant (gas) of lower pressure sucked into the second cylinder 410 is partially introduced into the vane chamber 413. Consequently, the second vane 430 is pushed by the refrigerant compressed in the second compression space V2 so as to be accommodated within the second vane slot 411. The suction chamber and the discharge chamber of the second compression space V2 are accordingly communicated with each other, and thereby the refrigerant gas sucked into the second compression space V2 cannot be compressed. Here, a great pressure difference occurs between the pressure applied to one side surface of the second vane 430 by the first restricting passage 414 disposed in the second cylinder 410 and the pressure applied to another side surface of the vane 430 by the second restricting passage 415. Accordingly, the pressure applied by the first restricting passage 414 shows a tendency to move toward the second restricting passage 415, thereby restricting the second vane 430.

Figure 10:
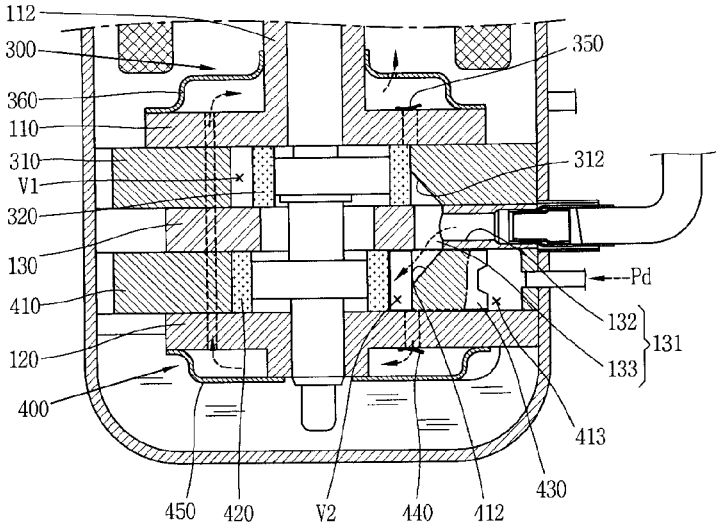
FIGS. 10 and 11 are longitudinal and horizontal cross-sectional views showing a power operation mode of the rotary compressor in accordance with FIG. 1.
Figure 11:
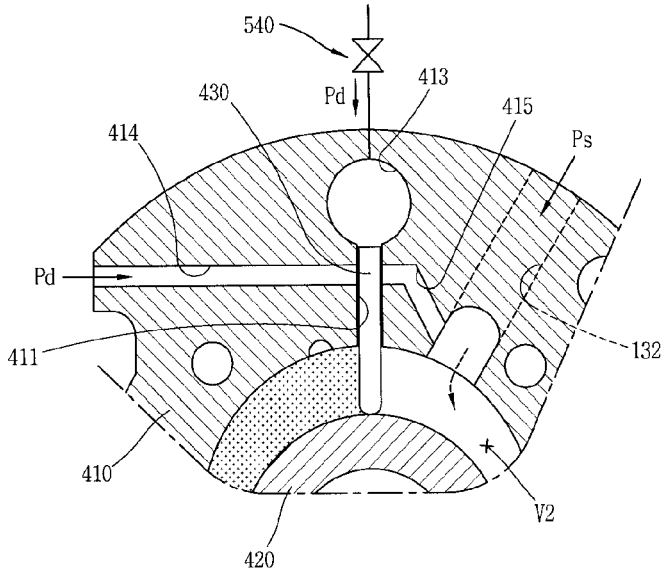

On the other hand, in a power mode of the compressor, as shown in FIGS. 10 and 11, when power is applied to the first mode switching valve 540, the suction pressure side connection pipe 510 is blocked accordingly, the discharge pressure side connection pipe 520 is connected to the common connection pipe 530. Accordingly, a high pressure gas within the casing 100 is supplied to the vane chamber 413 of the second cylinder 410 via the discharge pressure side connection pipe 520, so that the second vane 430 is pushed by the high pressure refrigerant filled in the vane chamber 413 to be maintained in a state of being press-contacted with the second rolling piston 420. Hence, the refrigerant gas introduced into the second compression space V2 is normally compressed and discharged. Here, a high pressure refrigerant gas or oil is supplied into the first restricting passage 414 disposed in the second cylinder 410 so as to press one side surface of the second vane 430. However, since the sectional area of the first restricting passage 414 is narrower than that of the second vane slot 411, the pressure applied from the side surface is lower than the pressure applied in back and forth directions of the vane chamber 413, accordingly, the first restricting passage 414 cannot restrict the second vane 430. Therefore, the second vane 430 partitions the second compression space V2 into a suction chamber and a discharge chamber by being press-contacted with the second rolling piston 420, so the entire refrigerant sucked into the second compression space V2 is compressed and discharged. Accordingly, the compressor or an air conditioner having the same can be operated with 100% of capacity.

Hereinafter, a process of switching the saving mode into the power mode of the compressor will be described.

Figure 12:
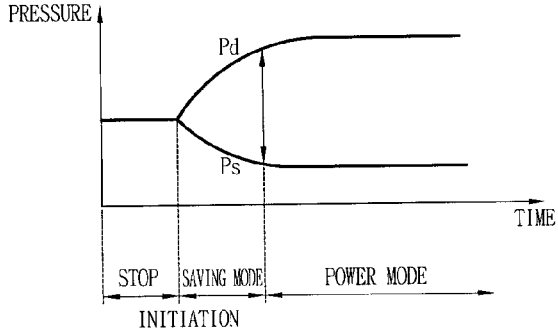
FIGS. 12 and 13 are graph and flowchart showing an operation state (mode) of the rotary compressor in accordance with FIG. 1.
Figure 13:
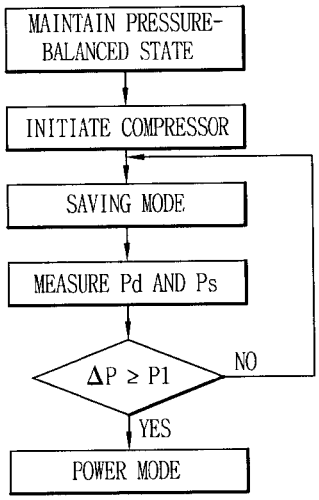

That is, as shown in FIGS. 12 and 13, in a stopped state, the compressor maintains a state of a suction pressure being the same to a discharge pressure after a pressure-balancing process.

Then, when the compressor is initiated, it is operated in a saving mode until the discharge pressure Pd is risen to the reference pressure P1. During this process, the first sensor 610 detects an internal pressure of the casing 100 or internal pressure of the discharge pipe 150 corresponding to the discharge pressure Pd, and simultaneously detects in real time an internal pressure of the suction pipe 140 corresponding to the suction pressure Ps. The control board 630 calculates a differential pressure ΔP between the discharge pressure Pd detected by the first sensor 610 and the suction pressure Ps detected by the second sensor 620, and compares the differential pressure ΔP with the preset reference pressure P1.

If the differential pressure ΔP is lower than the preset reference pressure P1, the control board 630 instructs the compressor to keep operated in the saving mode. On the other hand, if the differential pressure ΔP is higher than the preset reference pressure P1, the control board 630 instructs such that the compressor is switched into the power mode.

When the control board 630 instructs the switching into the power mode, as aforementioned, the common connection pipe 530 is connected to the discharge pressure side connection pipe 520 by the first mode switching valve 540 and the second mode switching valve 550, such that a high discharge pressure Pd is supplied into the vane chamber 413. Accordingly, the second vane 430 is kept contacted with the second rolling piston 420, allowing the operation even in the second compression part 400.

As such, the discharge pressure to be supplied to a rear side of the second vane is supplied after being higher than the reference pressure, so that the operation mode of the compressor can be switched from the saving mode into the power mode. Hence, the second vane can be press-contacted with the second rolling piston with being moved fast and accurately without vibration, thereby preventing beforehand noise or efficiency degradation due to the vibration of the second vane in the power mode of the compressor.

In the meantime, if the compressor according to the present invention is applied to a cooling apparatus, noise of the cooling apparatus can be reduced and simultaneously efficiency thereof can be improved.

Figure 14:
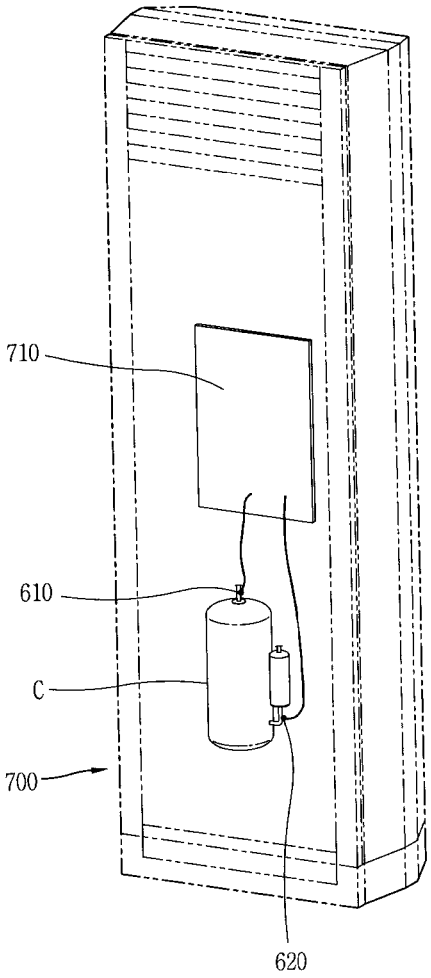
FIG. 14 is a schematic view showing an air conditioner employing the rotary compressor in accordance with FIG. 1.

For example, as shown in FIG. 14, a cooling apparatus 700 having a refrigerant compression type refrigerating cycle provided with a compressor, a condenser, an expanding apparatus and an evaporator may be configured such that a main board 710 for controlling an overall operation of the cooling apparatus can be connected with the first sensor 610 and the second sensor 620 installed in the compressor C.

Accordingly, a differential pressure between discharge pressure and suction pressure detected by the first and second sensors can be compared with a reference pressure stored in the main board, as stated above, so as to operate the first mode switching valve, thereby allowing the control unit to cooperate with the operation of the cooling apparatus.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

INDUSTRIAL APPLICABILITY

The variable capacity type rotary compressor according to the present invention may widely be applied to cooling apparatuses, such as home or commercial air conditioners.

The invention claimed is:

1. A variable capacity type rotary compressor, comprising:

a casing having a suction pipe and a discharge pipe;

at least one cylinder installed in an inner space of the casing;

at least one rolling piston configured to compress a refrigerant by being orbited in a compression space of the at least one cylinder;

at least one vane configured to partition the compression space of the at least one cylinder into a suction chamber and a discharge chamber in cooperation with the at least one rolling piston;

a chamber isolated within the inner space of the casing and filled with a refrigerant at a suction pressure or a discharge pressure formed at a rear side of the at least one vane;

a mode switching device configured to apply a variable pressure to the chamber;

a controller configured to control the mode switching device to switch an operation mode to a power mode by supplying the discharge pressure to the chamber when a differential pressure reaches a predetermined reference pressure, and to a saving mode by supplying the suction pressure to the chamber when the differential pressure does not reach the predetermined reference pressure; and a vane restricting device configured to restrict or release the at least one vane pressed by the mode switching device, wherein the vane restricting device is configured to restrict the at least one vane using a pressure in the inner space of the casing, wherein the at least one cylinder comprises:

a vane slot that guides movement of the vane in a radial direction;

a first restricting passage formed at a first side of the vane slot, in communication with the vane slot, and configured to restrict the vane by use of the differential pressure, the first restricting passage extending in a direction intersecting with a motion direction of the vane in the vane slot;

a suction hole formed at a second side of the vane slot opposite the first side of the vane slot at which the first restricting passage is formed and configured to connect the suction pipe to the inner space; and a second restricting passage formed at the second side of the vane slot opposite the first side of the vane slot and configured to communicate the vane slot with the suction hole, wherein a difference in pressure between the first restricting passage and the second restricting passage restricts the vane.

2. The compressor of claim 1, wherein the controller comprises a first sensor configured to detect a pressure of a refrigerant discharged from the at least one cylinder, a second sensor configured to detect a pressure of a refrigerant sucked into the at least one cylinder, and a control board configured to determine whether to switch the operation mode by comparing the detected values by the first and second sensors with the predetermined reference pressure.

3. The compressor of claim 2, wherein the first sensor is installed in the casing to detect the pressure in the inner space of the casing, or installed at the discharge pipe to detect an internal pressure of the discharge pipe.

4. The compressor of claim 2, wherein the second sensor is installed at the suction pipe to detect an internal pressure of the suction pipe.

5. The compressor of claim 2, wherein the control board comprises:

an input portion electrically connected to the first sensor and the second sensor and configured to receive the pressures measured by each of the first and second sensors;

a determining portion configured to determine a differential pressure between the discharge pressure and the suction pressure received by the input portion and monitor whether the differential pressure reaches the predetermined reference pressure so as to determine whether to switch the operation mode of the compressor; and an output portion configured to switch the operation mode of the compressor according to the determined result of the determining portion.

6. The compressor of claim 1, wherein the first restricting passage and the second restricting passage are formed on the same line.

7. The compressor of claim 1, wherein the at least one cylinder comprises a plurality of cylinders, each having an independent compression space, the plurality of cylinders being connected to one suction pipe such that the refrigerant is distributedly supplied into each compression space.

8. The compressor of claim 1, wherein the predetermined reference pressure is 2 $kgf/cm^2$.

9. A cooling apparatus having a refrigerant compression type refrigerating cycle that includes a compressor, a condenser, an expansion apparatus, and an evaporator, wherein the compressor is implemented as a compressor according to claim 1.

* * * * *